US009573072B2

(12) United States Patent
Cai

(10) Patent No.: US 9,573,072 B2
(45) Date of Patent: Feb. 21, 2017

(54) FLIPPING AND TRANSFORMING TOY VEHICLE CAPABLE OF GRIPPING TOYS

(71) Applicants: Guangdong Alpha Animation & Culture Co., Ltd., Shantou (CN); Guangdong Auldey Animation & Toy Co., Ltd., Guangzhou (CN); Guangzhou Alpha Culture Communications Co., Ltd., Guangzhou (CN)

(72) Inventor: Dongqing Cai, Shantou (CN)

(73) Assignees: Alpha Group Co., Ltd. (CN); Guangdong Auldey Animation & Toy Co., Ltd. (CN); Guangzhou Alpha Culture Communications Co., Ltd. (CN)

( * ) Notice: Subject to any disclaimer, the term of this patent is extended or adjusted under 35 U.S.C. 154(b) by 0 days.

(21) Appl. No.: 14/904,877

(22) PCT Filed: Jun. 30, 2015

(86) PCT No.: PCT/CN2015/082930
§ 371 (c)(1),
(2) Date: Jan. 13, 2016

(87) PCT Pub. No.: WO2016/065916
PCT Pub. Date: May 6, 2016

(65) Prior Publication Data

US 2016/0325198 A1 Nov. 10, 2016

(30) Foreign Application Priority Data

Oct. 28, 2014 (CN) ..... 2014 1 0584205

(51) Int. Cl.
*A63H 17/00* (2006.01)
*A63H 33/00* (2006.01)
*A63H 17/26* (2006.01)

(52) U.S. Cl.
CPC ..... *A63H 33/003* (2013.01); *A63H 17/004* (2013.01); *A63H 17/26* (2013.01)

(58) Field of Classification Search
CPC ..... A63H 17/00; A63H 17/004; A63H 17/02; A63H 17/26
See application file for complete search history.

(56) References Cited

U.S. PATENT DOCUMENTS 3,892,086 A * 7/1975 Gay ..... A63H 17/02 446/465
4,655,727 A * 4/1987 Swisher ..... A63H 33/003 446/470

(Continued)

FOREIGN PATENT DOCUMENTS

CN 203235253 U 10/2013
CN 203829639 U 9/2014

(Continued)

OTHER PUBLICATIONS

International Search Report for Application No. PCT/CN2015/082930 dated Oct. 15, 2015.

*Primary Examiner* — John Ricci
(74) *Attorney, Agent, or Firm* — Lerner, David, Littenberg, Krumholz & Mentlik, LLP

(57) ABSTRACT

A flipping and transforming toy vehicle capable of gripping toys, comprising a toy vehicle with elastic unfolding parts and flipping parts, toys to be gripped, an elastic gripping part and a snapping assembly. The elastic gripping part, the elastic unfolding parts, and the flipping part are folded and snapped through said snapping assembly to maintain the folded state. When the toy vehicle is pushed toward a toy (Continued)

such that the toy touches the snapping assembly, the snap connection of the elastic gripping part, the flipping part, and the elastic unfolding parts are released. When the snap connection is release, the elastic gripping part pops out to grip the toy, the flipping part turns downwardly to drive the toy vehicle to somersault, and each elastic unfolding part is unfolded, thereby transforming the toy vehicle from a vehicle form to a second form.

18 Claims, 9 Drawing Sheets

(56) References Cited

U.S. PATENT DOCUMENTS

| | | | | |
|---|---|---|---|---|
| 6,419,545 | B1 | 7/2002 | Motosko | |
| 6,672,937 | B1 * | 1/2004 | Motosko | A63H 17/26 446/431 |
| 6,939,197 | B1 * | 9/2005 | Hoeting | A63H 17/004 446/437 |
| 7,387,558 | B2 * | 6/2008 | Swisher | A63H 17/02 446/427 |
| 7,749,047 | B2 * | 7/2010 | Dunham | A63H 17/004 446/466 |
| 8,900,031 | B2 * | 12/2014 | Benedict | A63H 17/004 446/437 |
| 2013/0244535 | A1 * | 9/2013 | Martinez | A63H 33/003 446/330 |

FOREIGN PATENT DOCUMENTS

| | | |
|---|---|---|
| CN | 104353243 A | 2/2015 |
| CN | 204233757 U | 4/2015 |

* cited by examiner

FLIPPING AND TRANSFORMING TOY VEHICLE CAPABLE OF GRIPPING TOYS

CROSS-REFERENCE TO RELATED APPLICATIONS

The present application is a national phase entry under 35 U.S.C §371 of International Application No. PCT/CN2015/082930 filed Jun. 30, 2015, which claims priority from Chinese Application No. 201410584205.9 filed Oct. 28, 2014, all of which are hereby incorporated herein by reference.

FIELD OF THE INVENTION

The present invention relates to a toy for children, and specifically to a flipping and transforming toy vehicle capable of gripping toys.

DESCRIPTION OF THE RELATED ART

Toy vehicles have become one of the must-have toys in one's childhood. Current toy vehicles have more and more forms, models and functions, the forms include single-sided vehicles, double-sided vehicles, tipping wagons, tracked vehicles, etc.; the models include cars, trucks, buses and trains; the functions include hand-pushing, mechanically driving, electrically driving, transformable, capable of shooting bullets, etc. However, none of the existing toy vehicles can grip objects, namely when a toy vehicle is moving, it can grip an object when it hits the object. In such a way, the toy can be played by one single person or by two sides in an interactive way. During the play, a child can learn to make choices from numerous objects, and moreover, as well as how to obtain the selected object through just competition.

Existing transforming toy vehicles have the function of transforming from one form to another form through rotation or disassembly/assembly. Right now, most transforming toy vehicles basically don't have any special functions, such as the gripping function, other than moving or transformation. As a result, ways to play with existing transforming toy vehicles are simple and boring, and children would easily lose interest and gradually throw them away.

SUMMARY OF THE INVENTION

In light of the problems of the prior art, the object of the present invention is to provide a flipping and transforming toy vehicle capable of gripping toys with ingenious design, various ways to play and great fun, which can also make children to learn and improve through playing.

To attain the above object, the technical solution employed by the present invention is: a flipping and transforming toy vehicle capable of gripping toys, characterized in that it comprises:

a toy vehicle, said toy vehicle comprising a plurality of elastic unfolding parts, flipping parts and fixed part, the flipping parts being disposed at the bottom or bottom periphery of the toy vehicle, the plurality of elastic unfolding parts and flipping parts, when all in the folded state, forming, together with the fixed part, a vehicle form, and an opening being provided at the front end of the toy vehicle;

a number of toys to be gripped;

an elastic gripping part for gripping the toys, said elastic gripping part being disposed inside the opening of the toy vehicle or a position around the opening;

and a snapping assembly, the plurality of elastic unfolding parts and flipping parts being folded and then snapped through said snapping assembly to maintain the folded state, and the elastic gripping part being snapped through said snapping assembly to maintain the to-be-gripped state;

said snapping assembly being disposed inside the toy vehicle and the front end thereof extending into the opening, when the toy vehicle is pushed toward the toy such that the toy enters the opening and touches the snapping assembly, the snapping assembly releases the snap connection from the elastic gripping part, the flipping parts and the elastic unfolding parts, the elastic gripping part is popped out to grip the toy when the snap connection is released, the flipping part rotates downwardly to drive the toy vehicle to somersault when the snap connection is released, and each elastic unfolding part is unfolded when the snap connection is released, thereby transforming the toy vehicle from a vehicle form to a second form.

Wherein, the snapping assembly comprises a first snapping part and a second snapping part, the first snapping part being used for snap connection with the flipping parts and/or the elastic gripping part, the front end of the first snapping part extending out of the toy vehicle and into the opening, the second snapping part being used for snap connection with the plurality of elastic unfolding parts, wherein, when the first snapping part is used for snap connection with the flipping parts, the flipping parts engage with the elastic gripping part and the second snapping part, respectively, to achieve that the elastic gripping part is in a to-be-gripped state and the second snapping part is in a state of snap connection with the plurality of elastic unfolding parts when the flipping parts are in the snap connection state; when the first snapping part is used for snap connection with the flipping parts and the elastic gripping part, the flipping parts engage with the second snapping part to achieve that the second snapping part is in a state of snap connection with the plurality of elastic unfolding parts when the flipping parts are in the snap connection state; when the first snapping part is used for snap connection with the elastic gripping part, the elastic gripping part engages with the flipping parts to achieve that the flipping parts are in the snap connection state when the elastic gripping part is in the snap connection state, the flipping parts engage with the second snapping part to achieve that the second snapping part is in a state of snap connection with the plurality of elastic unfolding parts when the flipping parts are in the snap connection state.

The elastic gripping part according to the present invention may be an elastic single-arm gripping part, said elastic single-arm gripping part is disposed on the upper inner side surface or lower inner side surface of the opening, said elastic single-arm gripping part engages with the first snapping part or the flipping part to achieve that the elastic single-arm gripping part grips the toy when the toy touches the first snapping part to release the snap connection from the flipping parts and/or the elastic single-arm gripping part, or the elastic single-arm gripping part uses its own elasticity to achieve that, when the toy enters the opening, the elastic single-arm gripping part is first squeezed and then the elasticity of the elastic single-arm gripping part is restored to grip the toy.

Furthermore, the elastic single-arm gripping part may be an elastic tilting plate, the center of the elastic tilting plate is installed, through a rotating shaft and a torsional spring, at a position on the lower inner side surface of the opening, the rear part of the elastic tilting plate restricts, through the snap connection with the flipping parts, the front part of the elastic tilting plate from tilting upwardly, the flipping parts are in snap connection through the first snapping part, the toy touches the first snapping part when entering the opening, such that the first snapping part releases the snap connection from the flipping parts to flip the flipping parts and further release the snapping of the elastic tilting plate, thereby making the front part of the elastic tilting plate to tilt upwardly and lock the toy.

The elastic single-arm gripping part may further be an elastic locking protrusion, the elastic locking protrusion comprises a locking seat, a spring and a boss, the locking seat is designed integrally with the upper inner side surface of the opening, the spring is installed inside the locking seat, the boss is inserted into the locking seat and partially extends out of the locking seat, when the toy enters the opening, the toy first squeezes the boss, and under the elastic force of the spring, the boss extends downwardly, and the elasticity of the elastic single-arm gripping part is restored to grip the toy.

Corresponding to the elastic gripping part being an elastic single-arm gripping part, the first snapping part is a snapping plate disposed inside the toy vehicle and capable of moving forwardly and backwardly, the front end of the snapping plate extends out of the toy vehicle and into the opening, but does not extend out of the opening, the rear end of the snapping plate is connected to a reset spring that enables the snapping plate to automatically move forwardly and reset after moving backwardly, the bottom surface of the front part of the snapping plate is provided downwardly with a hook, the flipping part is correspondingly provided with a hole for engagement with the hook, thereby achieving the snap connection of the flipping part through the snapping plate.

The elastic gripping part according to the present invention may further be an elastic double-arm gripping part, said elastic double-arm gripping part is disposed on two sides of the opening, respectively, said elastic double-arm gripping part engages with the first snapping part or the flipping part to achieve that the elastic double-arm gripping part grips the toy when the toy touches the first snapping part to release the snap connection from the flipping parts and/or the elastic double-arm gripping part.

Furthermore, the elastic double-arm gripping part comprises two gripping arms that are installed, through a rotating shaft and a torsional spring, on two sides of the opening and rotate backwardly to be drawn together to two sides of the toy vehicle, the two gripping arms maintain the to-be-gripped state through the snap connection with the first snapping part (51) when they are drawn together to two sides of the toy vehicle, and at this moment, the elastic force of the torsional spring is in a restricted state.

Corresponding to the elastic gripping part being an elastic double-arm gripping part, the first snapping part is a snapping plate disposed inside the toy vehicle and capable of moving forwardly and backwardly, the front end of the snapping plate extends forwardly inside the toy vehicle and through the opening to go out of the opening, the front end part of the snapping plate is provided with a touch site for the toy to touch and assist the elastic double-arm gripping part to grip the toy, the bottom surface of the front part of the snapping plate is provided downwardly with a hook, the flipping part is correspondingly provided with a hole for engagement with the hook, thereby achieving the snap connection of the flipping part through the snapping plate, hooks are provided at positions on two sides close to the rear part of the snapping plate for snap connection with the gripping arms that are drawn together to two sides of the toy vehicle, and the rear end of the snapping plate is connected to a reset spring that enables the snapping plate to automatically move forwardly and reset after moving backwardly.

In addition to the elastic single-arm gripping part and the elastic double-arm gripping part, the elastic gripping part according to the present invention may further be a gripping part of other shapes or types.

The fixed part of the toy vehicle according to the present invention is a chassis part, the plurality of elastic unfolding parts together form a vehicle body of the toy vehicle when they are all in the folded state, the snapping assembly is moveably installed on the fixed part, the first snapping part is installed inside the fixed part and capable of moving forwardly and backwardly, the top part of the second snapping part extends out of the fixed part to be in a snap connection with the plurality of elastic unfolding parts and maintain the folded state. The toy vehicle according to the present invention is not provided with a driving device, namely the toy vehicle is pushed manually by a player. However, the toy vehicle according to the present invention may also be provided with a driving device inside the fixed part to drive the toy vehicle, and the driving mode may be mechanical driving or electrical driving.

To enable the elastic unfolding parts to engage mutually for fixation when folded and to elastically unfold when the snap connection is released, the elastic unfolding part comprises a rotating part that unfolds through rotation when the snap connection state is released, a torsional spring that elastically resets to unfold the rotating parts when the snap connection state is released, and an engagement part for mutual engagement between the rotating parts when the rotating parts are folded, the rotating parts maintain the vehicle form, after being drawn together and engaged, by resisting the elastic force of the torsional spring through the second snapping part. The rotation direction when the rotating parts are unfolded is multi-directional, and the rotating parts can be unfolded into either of six directions, up, down, left, right, front and back.

The second snapping part is a snap connection piece capable of moving forwardly and backwardly, the top part of the snap connection piece is provided forwardly or backwardly with a protrusion for snap connection with the buckle correspondingly provided on the rotating part, a reset spring capable of automatically resetting the snap connection piece after moving is provided between the snap connection piece and the fixed part, the bottom part of the snap connection piece engages with the flipping parts or the first snapping part to achieve that the snap connection piece is driven to move forwardly or backwardly when the flipping part flips or the first snapping part acts, thereby releasing the snap connection from the rotating part such that the rotating part is unfolded to transform the toy vehicle from the vehicle form to the second form.

Depending on various shapes of the second form that the toy vehicle is transformed to, the corresponding snap connection piece may be different, for example, the snap connection piece comprises a snap connection plate formed with a wedge-shaped hole in the center thereof, a wedge-shaped block inserted into the wedge-shaped hole, and a tension spring connected to the rear part of the snap connection plate, the snap connection plate is installed on the top surface of the fixed part and capable of moving forwardly and backwardly, the front end of the snap connection plate is provided with the protrusion for snap connection with the buckle of the rotating part, the reset spring is provided between the top part of the wedge-shaped block and the fixed part, the bottom part of the wedge-shaped block extends out of the vehicle bottom to the position of the flipping parts, the flipping parts restrict the wedge-shaped block from moving downwardly when the flipping parts are in the snap connection state, such that the snap connection plate is in the forward-moving state and the snap connection between the protrusion and the buckle is realized, when the flipping part flips, the restriction on the wedge-shaped block is released, such that the wedge-shaped block moves downwardly under the elastic force of the reset spring, thereby making the snap connection plate to move backwardly under the action of the tension spring to consequently release the snap connection between the protrusion and the buckle. Another example is that the snap connection piece is a snap block capable of moving forwardly and backwardly, the rear end of the snap block is provided with the protrusion for snap connection with the buckle of the rotating part, the reset spring is provided between the front end of the snap block and the fixed part, the bottom end of the snap block is provided with a boss by extending downwardly, the boss goes downwardly through the vehicle bottom to the position of the flipping parts, the rear end of the flipping part is correspondingly provided with a drive block that slants backwardly and downwardly, when the flipping part flips, the drive block rotates relatively forwardly and upwardly to drive the boss to move forwardly, thereby making the snap block to synchronously move forwardly and releasing the snap connection between the protrusion and the buckle. The snap connection piece according to the present invention is not limited to the above two structures.

The snapping assembly according to the present invention may also be a general snapping plate, the snap connection of all of the flipping parts, the elastic gripping part, and the elastic unfolding parts is achieved through the general snapping plate, the front end of the general snapping plate extends out of the toy vehicle and into the opening, when the toy vehicle is pushed toward the toy such that the toy enters the opening and touches the general snapping plate, the general snapping plate releases the snap connection from the flipping parts, the elastic gripping part and the elastic unfolding parts, thereby achieving that the toy vehicle grips the toy and flips to transform to a second form. Naturally, the snapping assembly may further comprise two or more snapping plates to achieve the snap.

To ensure that the toy vehicle still stands with the vehicle bottom facing down after flipping, the flipping part is a flipping plate with the rear end passing through the rotating shaft and the torsional spring and installed at the bottom of the toy vehicle, when the snapping assembly releases the snap connection from the flipping plate, the front end of the flipping plate flips downwardly and backwardly around the rotating shaft by 150° to 180°.

The second form of the toy vehicle according to the present invention after the transformation from the vehicle form is an animal form. Naturally, the second form may also be a plant form, a cartoon figure form, a weapon form, etc.

To facilitate gripping and ensure a firm gripping, and to further enhance fun in playing, the toy is a disc, a boss is provided at the center of both surfaces of the disc, a groove is formed between the boss and the periphery of the disc, the periphery of the disc extends outwardly with a projecting ring, and the surface of the boss is attached or embossed with a pattern for differentiating each toy.

According to the present invention, an elastic gripping part is provided at the front end of a toy vehicle, and at the same time, the toy vehicle is designed to be a transformable structure comprising a plurality of elastic unfolding parts, flipping parts and fixed part, then a snapping assembly is used to snap the elastic unfolding parts, flipping parts and elastic gripping part, and the snapping assembly releases all snap connections by contacting a toy. By using the movable feature of the toy vehicle, therefore, the toy vehicle is made to charge to a toy and hit the toy, which consequently triggers the snapping assembly to release snap connection from the elastic gripping part, the flipping parts and the elastic unfolding parts, such that the elastic gripping part grips the toy, the flipping parts rotate downwardly to drive the toy vehicle to somersault, and the elastic unfolding parts are unfolded, thereby transforming the toy vehicle from a vehicle form to a second form. These actions take place at the same time and in a row, such that the toy vehicle has fancier motion effect and is more attractive to players. As a result, the transforming toy vehicle is no longer just capable of boring running or transformation, the boring ways of play of existing transforming toy vehicles have been changed, and there are a variety of ways of play that last long; since the size and position of the elastic gripping part are limited, on the other hand, the intensity of mutual impact between the toy vehicle and the toy determines if the elastic gripping part can successfully grip the toy. Therefore, a child's coordination capability between hands and brain, as well as the ability to control the toy vehicle's movement direction and pushing strength, will be put to test. Through the play, a child can exercise and improve these abilities, and moreover, can learn how to make correct selections and how to use a correct way to obtain the selected object; since the toy vehicle can transform to a second form and patterns are provided on the toys to differentiate the toys, furthermore, the information may be used in interactive plays with two or more sides, which further enhances the ways to play the toy vehicle, and through interactive play, can enhance the children's awareness of competition and promote communications among children or between children and adults. The transforming toy vehicle has an ingenious design and a unique structure, which has various novel ways to play and leads to great fun. It effectively promotes education and communication so as to train children to adapt to today's society, and may be used on various toy vehicles of different forms, styles, and functions.

The present invention will be further described in detail below with reference to the accompanying drawings and embodiments.

DETAILED DESCRIPTION OF THE EMBODIMENTS

Figure 1:
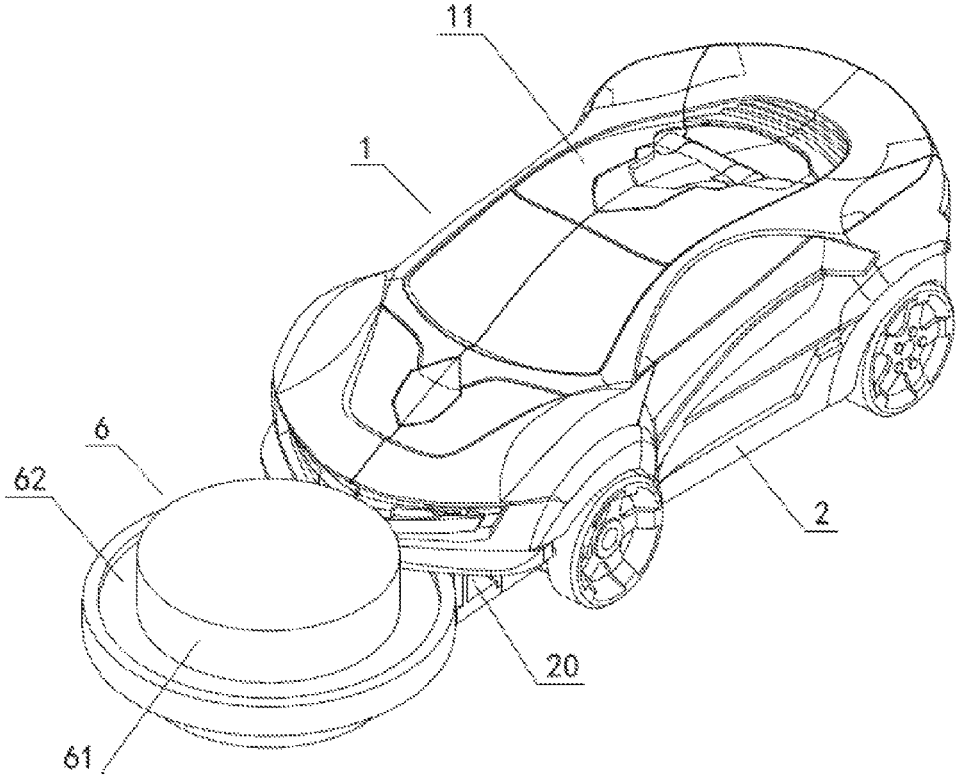
FIG. 1 is a view of the 3-D structure of the vehicle form of Example 1 according to the present invention.

As shown in FIG. 1 through FIG. 14, the flipping and transforming toy vehicle capable of gripping toys according to the present invention comprises: a toy vehicle, said toy vehicle comprising a plurality of elastic unfolding parts 1, flipping parts 3 and fixed part 2, the flipping parts 31 being disposed at the bottom or bottom periphery of the toy vehicle, the plurality of elastic unfolding parts and flipping parts 3, when all in the folded state, forming, together with the fixed part 2, a vehicle form, and an opening 20 being provided at the front end of the toy vehicle; a number of toys 6 to be gripped; an elastic gripping part 4 for gripping the toys 6, said elastic gripping part 4 being disposed inside the opening 20 of the toy vehicle or a position around the opening 20; and a snapping assembly 5, the plurality of elastic unfolding parts 1 and flipping parts 3 being folded and then snapped through said snapping assembly 5 to maintain the folded state, and the elastic gripping part 4 being snapped through said snapping assembly 5 to maintain the to-be-gripped state; said snapping assembly 5 being disposed inside the toy vehicle and the front end thereof extending into the opening 20, when the toy vehicle is pushed toward the toy 6 such that the toy 6 enters the opening 20 and touches the snapping assembly 5, the snapping assembly 5 releases the snap connection from the elastic gripping part 4, the flipping parts 3 and the elastic unfolding parts 1, the elastic gripping part 4 is popped out to grip the toy 6 when the snap connection is released, the flipping part 3 rotates downwardly to drive the toy vehicle to somersault when the snap connection is released, and each elastic unfolding part 1 is unfolded when the snap connection is released, thereby transforming the toy vehicle from a vehicle form to a second form. If the elastic gripping part 4 still grips the toy 6 after the toy vehicle has somersaulted and transformed, it indicates that the toy 6 is obtained. Through such a play, children can learn how to make correct selections and how to use a correct way to obtain the selected object. Moreover, the transforming toy vehicle can be played by two or more people to seize toys from each other, and see who has seized the most toys 6 by means of the same play mode within a prescribed period. Such a play can enhance the children's awareness of competition and promote communications among children or between children and adults.

Example 1

Figure 2:
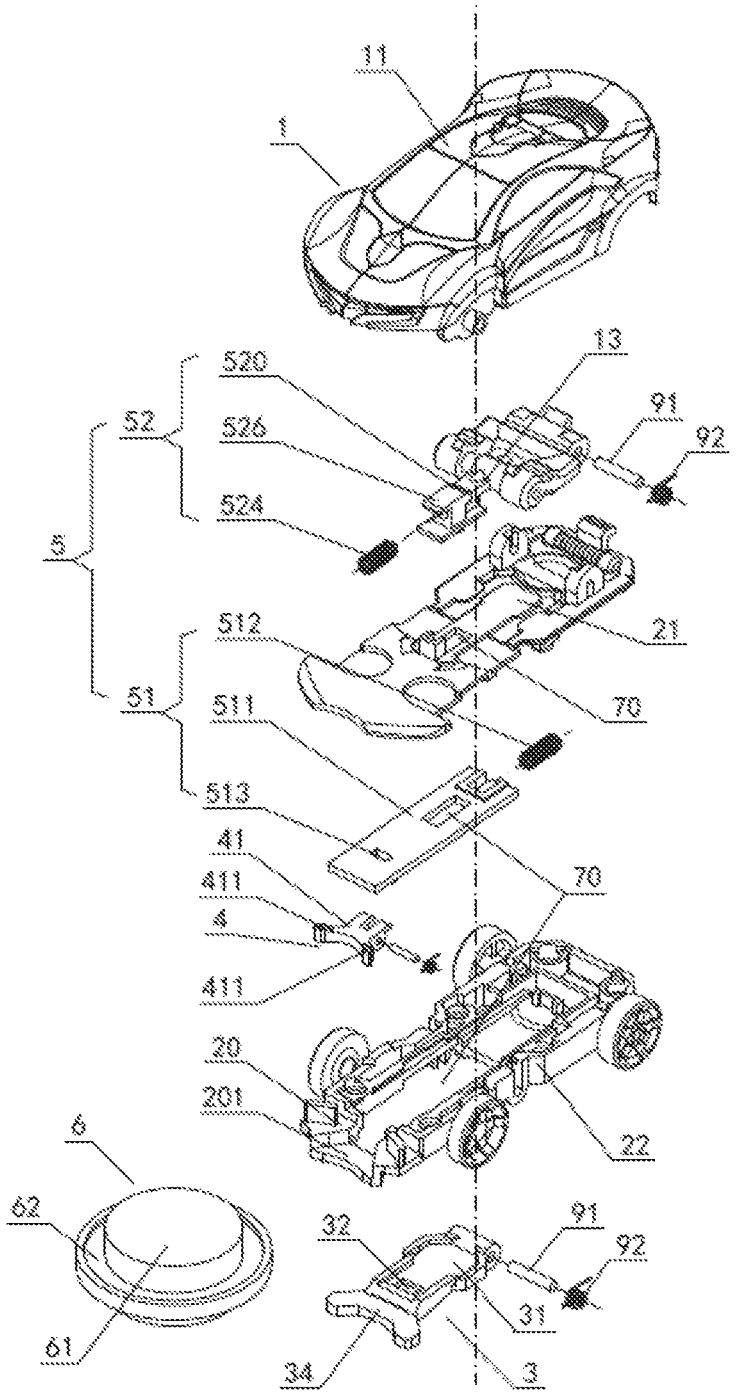
FIG. 2 is a view of the exploded structure of the vehicle form of Example 1 according to the present invention.
Figure 3:
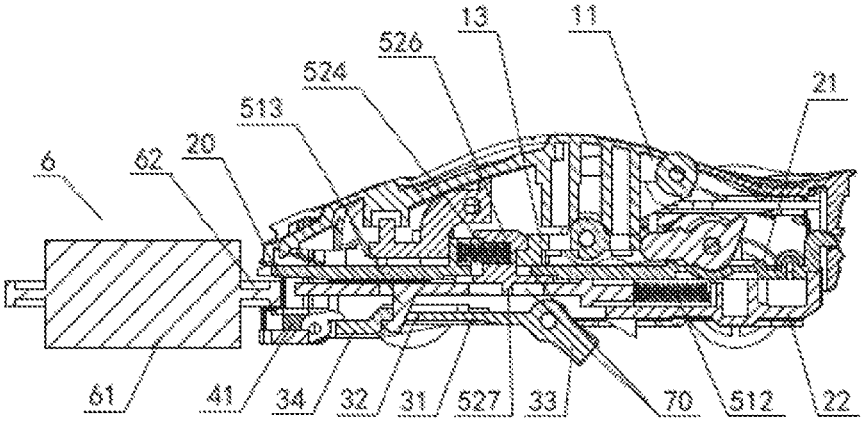
FIG. 3 is a cross-sectional view of the structure of the vehicle form of Example 1 according to the present invention.
Figure 4:
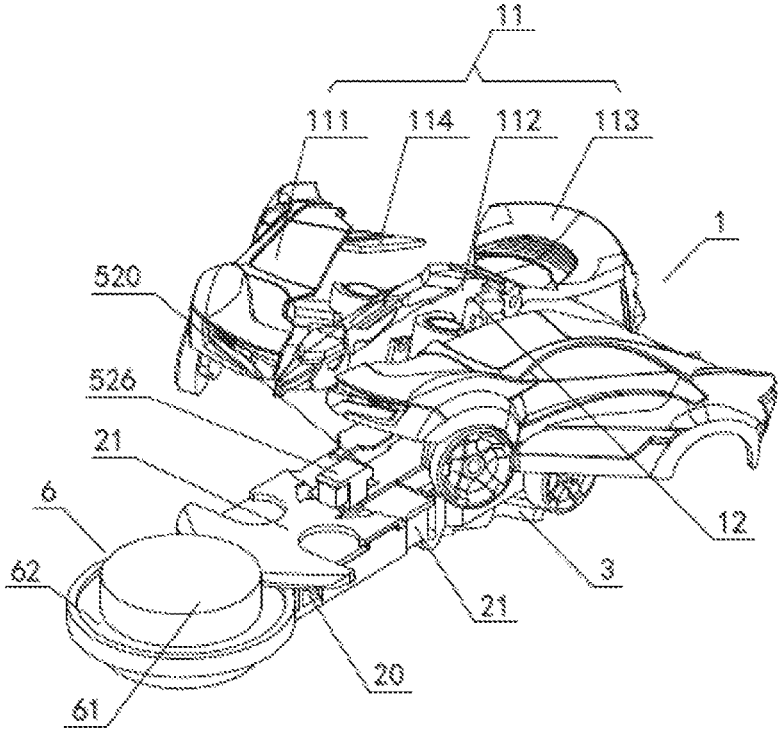
FIG. 4 is a view of the 3-D structure of the second form transformed from Example 1 according to the present invention.

As shown in FIG. 1 through FIG. 6, the second form that the toy vehicle in this example is transformed to is an eagle, wherein the fixed part 2 of the example is a chassis part, the plurality of elastic unfolding parts 1 together form a vehicle body of the toy vehicle when they are all in the folded state, the chassis part comprises a base 22 and a cover plate 21, and a space is reserved between the base 22 and the cover plate 21. As shown in FIG. 2, the snapping assembly 5 of the example comprises a first snapping part 51 and a second snapping part 52, the first snapping part 51 of the example is a snapping plate 511 disposed inside the space between the base 22 and the cover plate 21 and capable of moving forwardly and backwardly, the snapping plate 511 is a rectangular plate, the front end thereof extends out of the toy vehicle and into the opening 20, but does not extend out of the opening 20, the rear end of the snapping plate 511 is connected to a reset spring 512 that enables the snapping plate 511 to automatically move forwardly and reset after moving backwardly, the bottom surface of the front part of the snapping plate 511 is provided downwardly with a hook 513, a square hole 70 is formed on the base 22 for the hook 513 of the snapping plate 511 to extend downwardly and for moving forwardly and backwardly. The flipping part 3 of the example is a flipping plate 31 with the rear end passing through the rotating shaft 91 and the torsional spring 92 and installed at the bottom of the toy vehicle, the front part of the flipping plate 31 is correspondingly provided with a hole 32 for engagement with the hook 513, thereby achieving the snap connection of the flipping plate 31 through the snapping plate 511, the front end of the flipping plate 31 extends forwardly with a snap connection part 34, and the snap connection part 34 is used for snap connection with the elastic gripping part 4. The elastic gripping part 4 of the example is an elastic single-arm gripping part, disposed on the lower inner side surface of the opening 20, a recess 201 is formed on the lower inner side surface of the opening 20 for placing the elastic single-arm gripping part, the elastic single-arm gripping part is specifically an elastic tilting plate 41 with a rotating shaft 91 and a torsional spring 92 passing through the center thereof, shaft holes are formed correspondingly on two sides of the rear part of the recess 201 for connecting the rotating shaft 91, the elastic tilting plate 41 is a Y-shaped plate with the branched end being the front part, a boss 411 projects out of the top surface of the branched end, the rear end of the elastic tilting plate 41 is in a to-be-gripped state through snap connection with the snap connection part 34 at the front end of the flipping plate 31, and at this moment, the elastic force of the torsional spring 92 is also restricted, as shown in FIG. 3. The second snapping part 52 of the example is a snap block 526 capable of moving forwardly and backwardly, the snap block 526 is I-shaped, a square hole 70 is similarly formed at the position on the cover plate 21 corresponding to the snap block 526 for the snap block 526 to go through, the lower crossbar of the snap block 526 is disposed on the top surface of the snapping plate 511, a short crossbar on the top of the rear end of the snap block 526 forms a protrusion 520 for snap connection with the elastic unfolding part 1, a recessed hole is formed on the vertical bar in the middle of the snap block 526, the recessed hole has an opening end facing forward, the fixed part 2 is provided with a concave shaped projection in the front direction of the snap block 526, a reset spring 524 is provided between the recessed hole and the projection, the bottom part of the lower crossbar of the snap block 526 is provided with a boss 527 by extending downwardly, the boss 527 goes downwardly through the vehicle bottom to the position of the flipping parts 31, a square hole 70 is further formed on the snapping plate 511 and the base 22 for the boss 527 to extend downwardly, the rear end of the flipping plate 31 is correspondingly provided with a drive block 33 that slants backwardly and downwardly, when the flipping part 3 flips, the drive block 33 rotates relatively forwardly and upwardly to drive the boss 527 to move forwardly, thereby making the snap block 526 to synchronously move forwardly and releasing the snap connection between the protrusion 520 and the elastic unfolding part 1.

Figure 6:
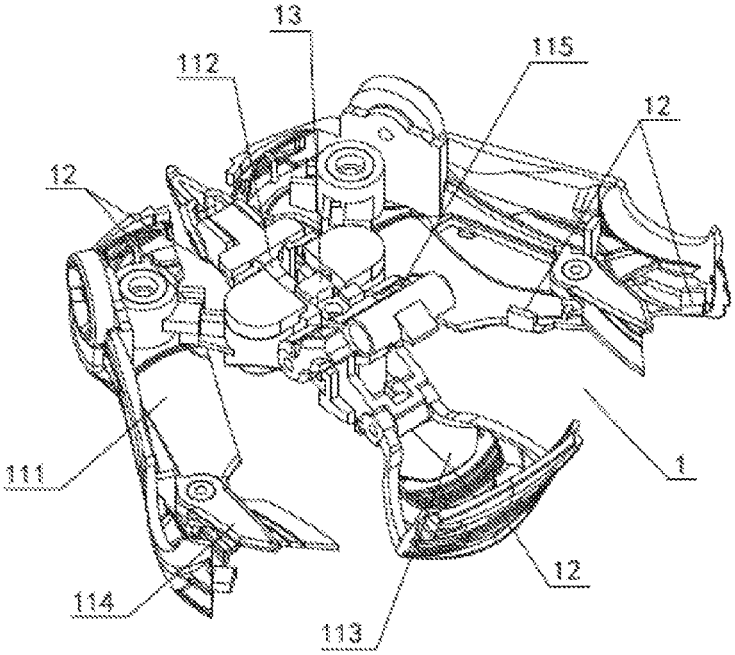
FIG. 6 is a view of the 3-D structure of the vehicle body of the second form of Example 1 according to the present invention.

As shown in FIG. 6, the elastic unfolding part 1 of this example comprises a rotating part 11 that unfolds through rotation when the snap connection state is released, and an engagement part 12 for mutual engagement between the rotating parts 11 when the rotating parts 11 are folded, the rotating parts 11 are connected with the fixed part 2 through the rotating shaft 91 and the torsional spring 92, one of the rotating parts 11 is formed with a buckle 13 for snapping with the protrusion 520 of the snap block 526, the buckle 13 is connected fixedly or moveably with a rotating part 11, and the rotating parts 11 maintain the vehicle form, after being drawn together and engaged, by resisting the elastic force of the torsional spring 92 through the snap connection between the protrusion 520 and the buckle 13. The rotating parts 11 of this example comprise a wing rotating part 111, a feather rotating part 114, a body rotating part 112, a tail rotating part 113 and a claw rotating part 115, wherein the wing rotating part 111 is provided with an engagement boss 12 for engagement with an engagement recess 12 provided on the body rotating part 112, its tail rotating part 113 is provided with an engagement part 12 for engagement with the rear end of the cover plate 21, the buckle 13 is rotatably disposed on the body rotating part 112, the body rotating part 112 and the claw rotating part 115 are both in snap connection with the protrusion 520 through the buckle 13 and in a folded state, and the feather rotating part 114 is folded through the wing rotating part 111 being folded. The toy 6 of this example is a disc 6, a boss 61 is provided at the center of both surfaces of the disc 6, a groove 62 is formed between the boss 61 and the periphery of the disc 6, and the surface of the boss 61 may be attached or embossed with a pattern for differentiating each toy 6.

Figure 5:
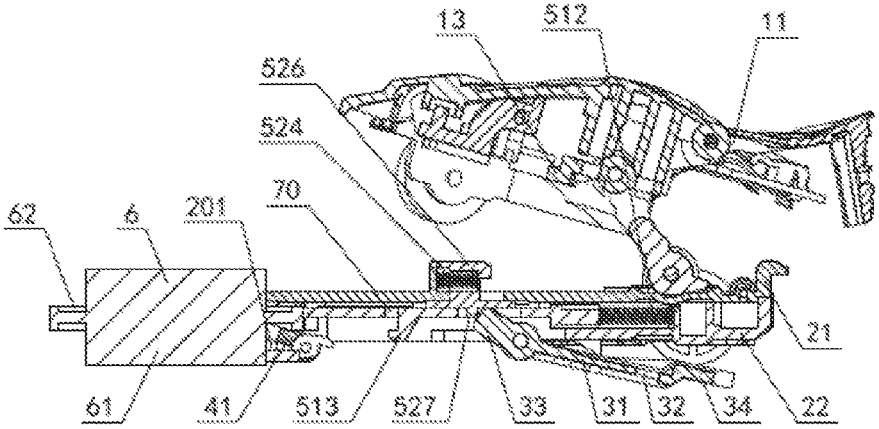
FIG. 5 is a cross-sectional view of the structure of the second form of Example 1 according to the present invention.

As shown in FIG. 3, when the toy vehicle is in the vehicle form, namely a state in which it has not hit the disc 6 to grip the disc 6, the snapping plate 511 is in the forward-moving state under the action of a reset spring 512 at the rear part thereof, the front part thereof is inside the opening 20, and the hook 513 of the snapping plate 511 hooks the hole 32 of the flipping plate 31, such that the snap connection part 34 at the front end of the flipping plate 31 stands against the rear part of the elastic tilting plate 41, consequently the front part of the elastic tilting plate 41 is in a non-tilted state, while the snap block 526 is in the backward-moving state under the action of its reset spring 524, its protrusion 520 and the buckle 13 on the claw rotating part 115 are in a snap connection state, the boss 527 therebelow is similarly at a position behind, and the drive block 33 at the rear part of the flipping plate 31 is similarly in a state that slants backwardly and downwardly as the flipping plate 31 is snapped; when the toy vehicle is pushed toward the disc 6, as shown in FIG. 5, if the disc 6 just enters the opening 20 and touches the snapping plate 511 such that the snapping plate 511 moves backwardly, the hook 513 of the snapping plate 511 disengages from the hole 32 of the flipping plate 31, the front end of the flipping plate 31 pushes up the entire toy vehicle by rotating downwardly under action of its torsional spring 92, such that the entire toy vehicle flips; due the rotation of the flipping plate 31, the snap connection part 34 at the front end thereof disengages from the snap connection with the elastic tilting plate 41, the front part of the elastic tilting plate 41 tilts upwardly, such that the boss 411 at the front part snaps into the groove 62 of the disc 6, thereby gripping the disc 6; since the flipping plate 31 rotates downwardly and backwardly by about 160°, meanwhile, the drive block 33 is similarly made to rotate from back and below to front and up, and then is in contact with the boss 527 of the snap block 526 and pushes the boss 527 to move forwardly, namely making the snap block 526 to move forwardly such that the protrusion 520 of the snap block 526 disengages from the snap connection with the buckle 13 on the claw rotating part 111, and therefore the claw rotating part 111 is unfolded under the elastic force of its own torsional spring 92, other rotating parts 11 are correspondingly unfolded under the elastic force of their own torsional springs 92, such that the toy vehicle is transformed to the eagle form.

Example 2

Figure 7:
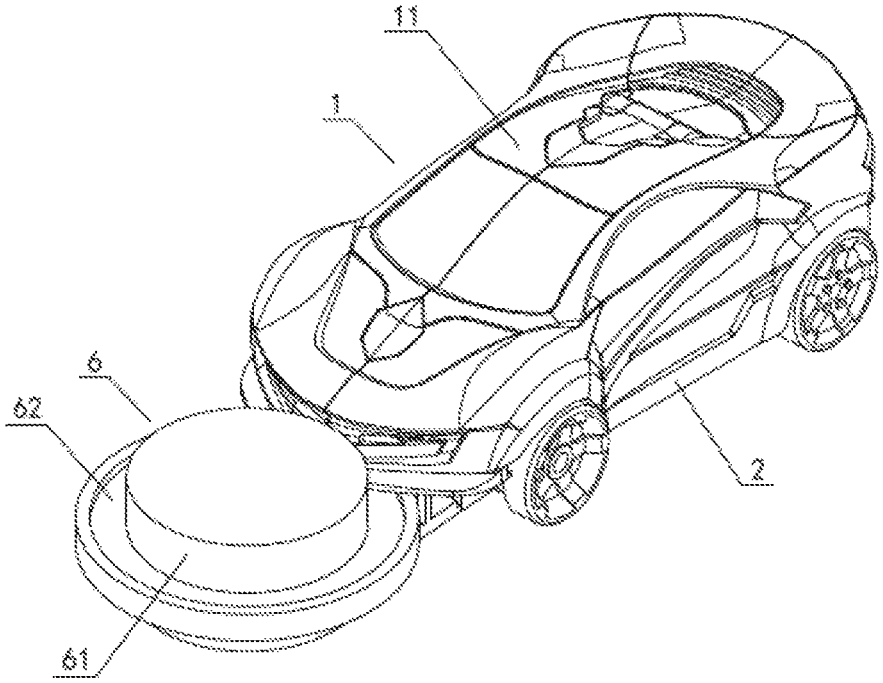
FIG. 7 is a view of the 3-D structure of the vehicle form of Example 2 according to the present invention.
Figure 8:
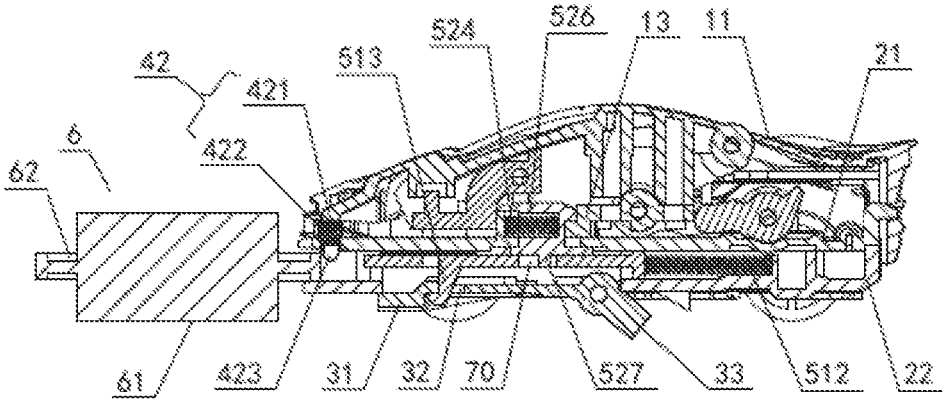
FIG. 8 is a cross-sectional view of the structure of the vehicle form of Example 2 according to the present invention.
Figure 9:
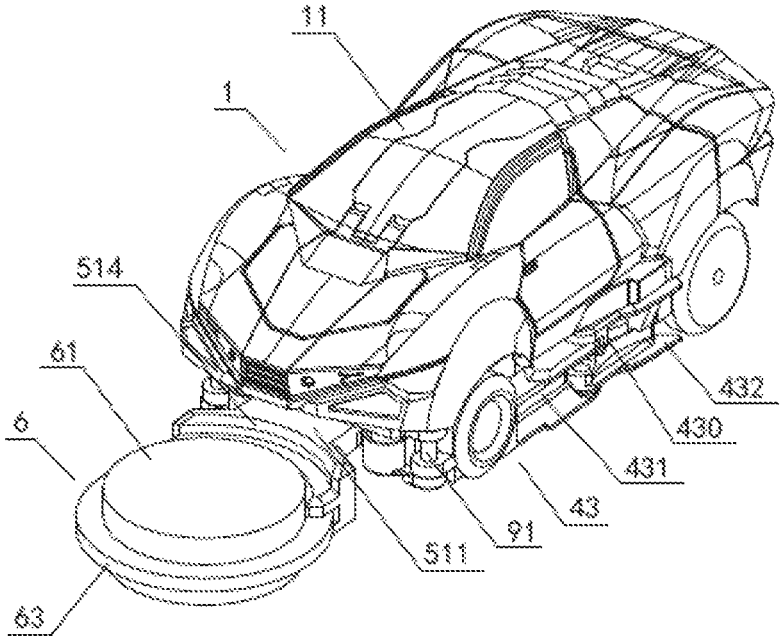
FIG. 9 is a view of the 3-D structure of the vehicle form of Example 3 according to the present invention.

As shown in FIG. 7 through FIG. 8, the second form that the toy vehicle in this example is transformed to is similarly an eagle. It is different from Example 1 in that the elastic single-arm gripping part of this example is an elastic locking protrusion 42 that triggers gripping on its own, the elastic locking protrusion 42 comprises a locking seat 421, a spring 422 and a boss 423, the locking seat 421 is designed integrally with the upper inner side surface of the opening 20, the spring 422 is installed inside the locking seat 421, the boss 423 is inserted into the locking seat 421 and partially extends out of the locking seat 421, since the bottom end surface of the boss 423 is circular, a force component would be generated, when the edge of the disc 6 hits the boss 423, to squeeze the boss 423 to overcome the elastic force of the spring 422 and contract into the locking seat 421, the toy vehicle continues to move toward the disc 6 until the boss 423 enters the groove 62 of the disc 6, the boss 423 loses the squeezing force and resets downwardly under the elastic force of the spring 422 to be snapped into the groove 62, achieving the gripping of the disc 6, as shown in FIG. 8, another difference is the flipping plate 31, since the flipping plate 31 no longer needs to be in snap connection with the elastic single-arm gripping part, there is no need to provide a snap connection part 34 at the front end of the flipping plate 31. Otherwise, the other structure is the same as in Example 1, which will not be described herein.

Example 3

Figure 10:
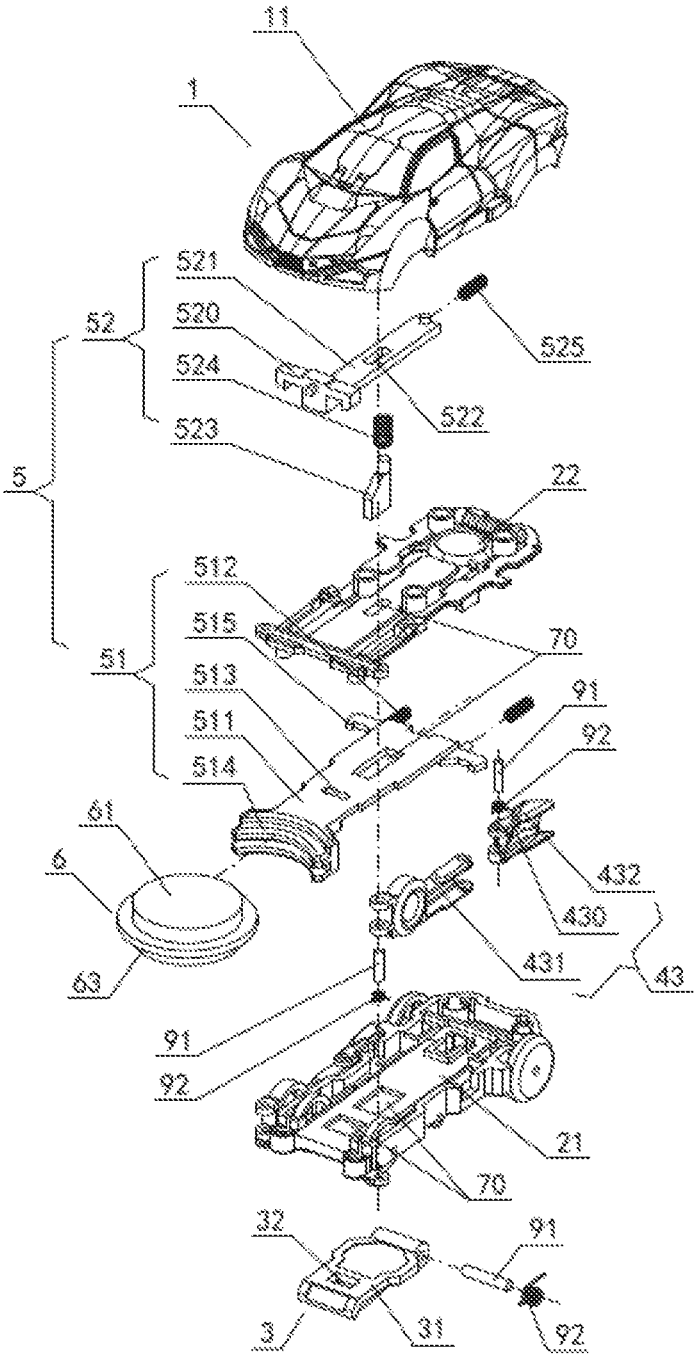
FIG. 10 is a view of the exploded structure of the vehicle form of Example 3 according to the present invention.
Figure 11:
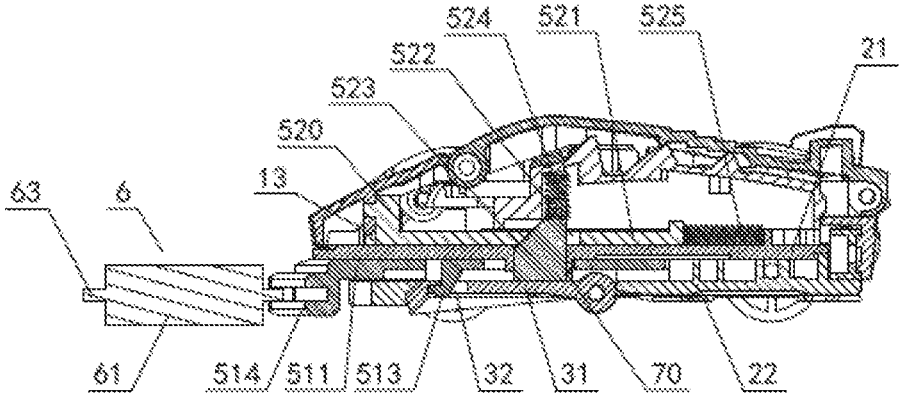
FIG. 11 is a cross-sectional view of the structure of the vehicle form of Example 3 according to the present invention.
Figure 12:
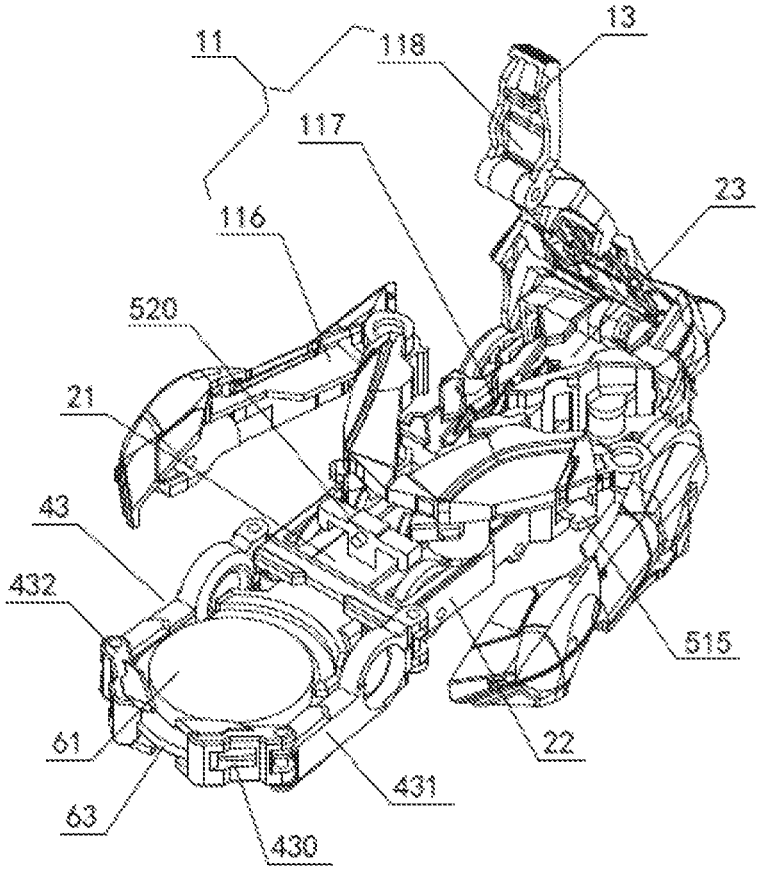
FIG. 12 is a view of the 3-D structure of the second form transformed from Example 3 according to the present invention.

As shown in FIG. 9 through FIG. 14, the second form that the toy vehicle in this example is transformed to is a scorpion form, wherein the fixed part 2 of the example is a chassis part and the scorpion body 23 when transformed to the scorpion form, while the plurality of elastic unfolding parts 1 together form a vehicle body of the toy vehicle when they are all in the folded state, the chassis part further comprises a base 22 and a cover plate 21, and a space is reserved between the base 22 and the cover plate 21. As shown in FIG. 10, the elastic gripping part 4 of this example is an elastic double-arm gripping part, said elastic double-arm gripping part is disposed on two sides of the opening, respectively; the snapping assembly 5 of the example comprises a first snapping part 51 and a second snapping part 52, the first snapping part 51 is a snapping plate 511 disposed inside the space between the base 22 and the cover plate 21 and capable of moving forwardly and backwardly, the snapping plate 511 is a rectangular plate, the front end thereof extends inside the toy vehicle and through the opening 20 of the toy vehicle to go out of the opening 20, the front end part of the snapping plate 511 extending out of the opening 20 is provided with a touch site 514 for the toy 6 to touch and assist the elastic double-arm gripping part to grip the toy 6, the touch site 514 is a semi-arc recess, the bottom surface of the front part of the snapping plate 511 is provided downwardly with a hook 513, a square hole 70 is formed on the base 22 for the hook 513 to extend downwardly and for moving forwardly and backwardly. The flipping part 3 of the example is a flipping plate 31 with the rear end passing through the rotating shaft 91 and the torsional spring 92 and installed at the bottom of the toy vehicle, the front part of the flipping plate 31 is correspondingly provided with a hole 32 for engagement with the hook 513, thereby achieving the snap connection of the flipping plate 31 through the snapping plate 511, hooks 515 are provided at positions on two sides close to the rear part of the snapping plate 511 for snap connection with the elastic double-arm gripping part that is drawn together to two sides of the toy vehicle, and the rear end of the snapping plate 511 is connected to a reset spring 512 that enables the snapping plate 511 to automatically move forwardly and reset after moving backwardly. The elastic double-arm gripping part of the example comprises two gripping arms 43 that are installed, through a rotating shaft 91 and a torsional spring 92, on two sides of the opening 20 and rotate backwardly to be drawn together to two sides of the toy vehicle, the gripping arms 43 are formed by a long arm 431 and a short arm 432 through hinge connection, the torsional spring 92 is disposed at the hinge, the rotating shaft 91 and the torsional spring 92 connected to two sides of the opening 20 are connected with the other end of the long arm 431, a hole 430 is formed on the short arm 432, the gripping arms 43 maintain the to-be-gripped state through the snap connection between the hole 430 of the short arm 432 and the hook 515 of the snapping plate 511 when they are drawn together to two sides of the toy vehicle, and at this moment, the elastic force of both of the two torsional spring 92 is in a restricted state, as shown in FIG. 11.

As shown in FIG. 10 and FIG. 11, the second snapping part 52 of the example comprises a snap connection plate 521 formed with a wedge-shaped hole 522 in the center thereof, a wedge-shaped block 523 inserted into the wedge-shaped hole 522, and a tension spring 525 connected to the rear part of the snap connection plate 521, the snap connection plate 521 is installed on the top surface of the cover plate 21 of the fixed part 2 and capable of moving forwardly and backwardly, the front end thereof is provided with the protrusion 520 for snap connection with the elastic unfolding part 1, the reset spring 524 is provided between the top part of the wedge-shaped block 523 and the top part of the scorpion body 23, the bottom part of the wedge-shaped block 523 extends out of the vehicle bottom to the position of the flipping plate 31, both the cover plate 21 and the base 22 are formed with a square hole 70 for the wedge-shaped block 523 to go through, when the flipping plate 31 is in the snap connection state, the flipping plate 31 restricts the wedge-shaped block 523 from moving downwardly, such that the snap connection plate 521 is in the forward-moving state and the snap connection between the protrusion 520 and the elastic unfolding part 1 is realized, when the flipping plate 31 flips, the restriction on the wedge-shaped block 523 is released, such that the wedge-shaped block 523 moves downwardly under the elastic force of the reset spring 524, thereby making the snap connection plate 521 to move backwardly under the action of the tension spring 525 to consequently release the snap connection between the protrusion 520 and the elastic unfolding part 1.

Figure 14:
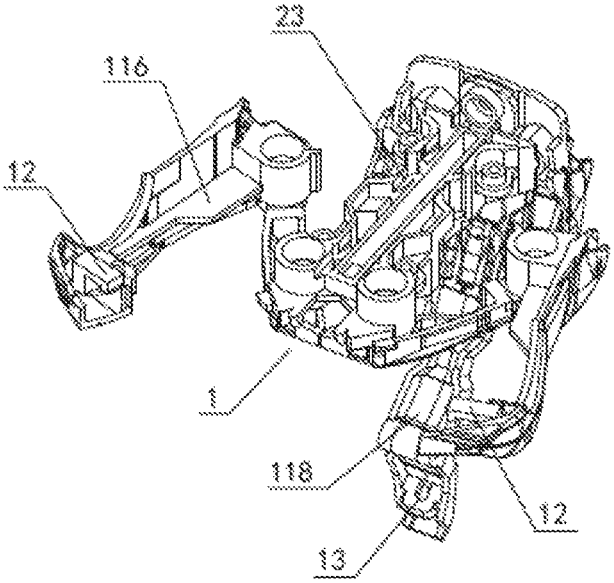
FIG. 14 is a view of the 3-D structure of the vehicle body of the second form of Example 3 according to the present invention.

As shown in FIG. 14, the elastic unfolding part 1 of this example comprises a rotating part 11 that unfolds through rotation when the snap connection state is released, and an engagement part 12 for mutual engagement between the rotating parts 11 when the rotating parts 11 are folded, the rotating parts 11 are connected with the fixed part 2 through the rotating shaft 91 and the torsional spring 92, one of the rotating parts 11 is formed with a buckle 13 for snapping with the protrusion 520 of the snap connection plate 521, and the rotating parts 11 maintain the vehicle form, after being drawn together and engaged, by resisting the elastic force of the torsional spring 92 through the snap connection between the protrusion 520 and the buckle 13. The protrusion 520 of this example is a "hill" shaped protrusion 520, snapping positions are formed on two sides of the "hill" shaped protrusion 520, the front end surface of the vertical bar in the middle is provided with an elastic boss, the rotating parts 11 of this example comprise two chela rotating parts 116, a ridge rotating part 117 and a telson rotating part 118, wherein the chela rotating parts 116 are provided with engagement bosses 12 for engagement with snapping positions of the "hill" shaped protrusion 520, the buckle 13 is fixedly disposed at the end of the telson rotating part 118, the buckle 13 is a round hole for the elastic boss to extend in, the telson rotating part 118 is in a folded state by snapping the elastic boss into the round hole, and the ridge rotating part 117 is folded through the telson rotating part 118 being folded. The toy 6 of this example is a disc 6, a boss 61 is provided at the center of both surfaces of the disc 6, the surface of the boss 61 is attached or embossed with a pattern for differentiating each toy 6, the periphery of the disc 6 extends outwardly with a projecting ring 63, and the gripping contact surface of the gripping arms 43 is correspondingly provided with a wrapping recess 433 capable of partially wrapping the projecting ring 63, thereby ensuring a firm grip.

Figure 13:
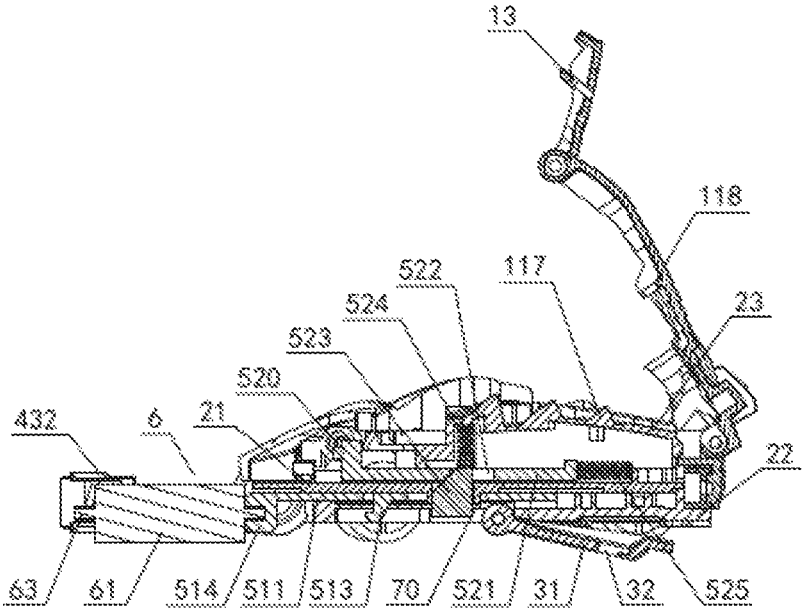
FIG. 13 is a cross-sectional view of the structure of the second form of Example 3 according to the present invention.

As shown in FIG. 11, when the toy vehicle is in the vehicle form, namely a state in which it has not hit the disc 6 to grip the disc 6, the snapping plate 511 is in the forward-moving state under the action of a reset spring 512 at the rear part thereof, the front part thereof extends out of the opening 20, the hook 515 at the rear side of the snapping plate 511 is in the forward-moving state and hooks the gripping arms 43 that are drawn together to two sides of the toy vehicle, the hook 513 at the bottom part of the snapping plate 511 hooks the hole 32 of the flipping plate 31, such that the top surface of the flipping plate 31 stands against the wedge-shaped block 523, and the slanted surface of the wedge-shaped block 523 acts on the slanted surface of the wedge-shaped hole 522 of the snap connection plate 521, which makes the snap connection plate 521 to be in the forward-moving state. At this moment, the elastic boss on the "hill" shaped protrusion 520 of the snap connection plate 521 blocks the telson rotating part 118, and the snapping positions on two sides of the "hill" shaped protrusion 520 snap the chela rotating parts 116; when the toy vehicle is pushed toward the disc 6, as shown in FIG. 13, if the disc 6 just touches the semi-arc recess 514 at the front end of the snapping plate 511 such that the snapping plate 511 moves backwardly, the hook 515 of the snapping plate 511 moves backwardly and disengages from the hole 430 of the gripping arms 43, when the snap connection is released from the gripping arms 43, both the long arm 431 and the short arm 432 rotate forwardly under the elastic force of the torsional spring 92, and can surround the disc 6 like human hands; due to the backward movement of the snapping plate 511, similarly, the hook 513 disengages from the hole the hole 32 of the flipping plate 31, the front end of the flipping plate 31 pushes up the entire toy vehicle by rotating downwardly by about 180° under action of its torsional spring 92, such that the entire toy vehicle flips; due the rotation of the flipping plate 31, the bottom of the wedge-shaped block 523 loses the support and therefore moves downwardly under the elastic force of the reset spring 524 at its top part, thereby losing the action on the snap connection plate 521, and as a result, the snap connection plate 521 move backwardly under the action of the tension spring 92 at its rear part, such that the elastic boss disengages from the snap connection with the telson rotating part 118, and the snapping positions disengage from the snap connection with the chela rotating parts 116, the telson rotating part 118 and the chela rotating parts 116 are consequently unfolded under the elastic force of their own torsional springs 92, the ridge rotating part 117 correspondingly loses the engagement and is unfolded under the elastic force of its own torsional spring 92, such that the toy vehicle is transformed to the scorpion form.

The specific way of playing with the toy vehicle according to the present invention is as follows:

One player games: spread the discs 6 at positions relatively far away from the front of the player, hold the toy vehicle with one hand, push the toy vehicle toward the selected disc 6, when the toy vehicle just touches the toy 6, the elastic gripping part 4 would grip the disc 6, depending on the power and angle of the push of the toy vehicle by the player, as well as the inertia and vibration during the flipping and transformation of the toy vehicle, the elastic gripping part 4 may not necessarily be able to grip the disc 6. Through this game, a child's coordination capability between hands and brain can be practiced, and the child's control abilities, such as sense of direction and sense of strength.

Games with two or more players: spread the discs 6 at positions between two players, determine the order of play, the first player first pushes his/her toy vehicle to grip the selected disc 6, subsequently the second player pushes his/her toy vehicle regardless of whether the first player successfully grips the disc 6 this time. In such a way, the winner will be the one who has obtained the most discs 6 within a prescribed time or when all discs 6 have been gripped. Through this game, the children's awareness of competition can be enhanced, and they can also learn how to make correct selections and how to use a correct way to obtain a desired object.

Extended games: a further development of the games with two or more players. The games are related to the pattern information on discs 6, the power of the discs 6 is differentiated according to the patterns on the discs 6. Within a prescribed time or a prescribed number of plays, the two sides alternately grip the discs 6, and at the end, the power is compared by summing up all gripped discs 6 with the more powerful side as the winner. In such a game, the winner is not the one who grips the more. If one side grips more discs 6 that are weaker, it is still possible for that side to lose the game. Therefore, this game further focuses on the selection of target discs 6 and determination on probability of whether they can be gripped by players, which can further train children to rapidly select from numerous objects what are need and have a high success rate.

Although the present invention is described with reference to specific examples, the description does not intend to limit the present invention. With reference to the description of the present invention, those skilled in the art can anticipate other variations to the published examples, which shall be encompassed by the claims.

The invention claimed is:

1. A flipping and transforming toy vehicle capable of gripping toys, characterized in that it comprises:

a toy vehicle, said toy vehicle comprising a plurality of elastic unfolding parts, flipping parts and fixed part, the flipping parts being disposed at the bottom or bottom periphery of the toy vehicle, the plurality of elastic unfolding parts and flipping parts, when all in the folded state, forming, together with the fixed part, a vehicle form, and an opening being provided at the front end of the toy vehicle;

a number of toys to be gripped;

an elastic gripping part for gripping the toys, said elastic gripping part being disposed inside the opening of the toy vehicle or a position around the opening;

and a snapping assembly, the plurality of elastic unfolding parts and flipping parts being folded and then snapped through said snapping assembly to maintain the folded state, and the elastic gripping part being snapped through said snapping assembly to maintain the to-be-gripped state;

said snapping assembly being disposed inside the toy vehicle and the front end thereof extending into the opening, when the toy vehicle is pushed toward the toy such that the toy enters the opening and touches the snapping assembly, the snapping assembly releases the snap connection from the elastic gripping part, the flipping parts and the elastic unfolding parts, the elastic gripping part is popped out to grip the toy when the snap connection is released, the flipping part rotates downwardly to drive the toy vehicle to somersault when the snap connection is released, and each elastic unfolding part is unfolded when the snap connection is released, thereby transforming the toy vehicle from a vehicle form to a second form.

2. The flipping and transforming toy vehicle capable of gripping toys according to claim 1, characterized in that the snapping assembly comprises a first snapping part and a second snapping part, the first snapping part being used for snap connection with the flipping parts and/or the elastic gripping part, the front end of the first snapping part extending out of the toy vehicle and into the opening, the second snapping part being used for snap connection with the plurality of elastic unfolding parts, wherein, when the first snapping part is used for snap connection with the flipping parts, the flipping parts engage with the elastic gripping part and the second snapping part, respectively, to achieve that the elastic gripping part is in a to-be-gripped state and the second snapping part is in a state of snap connection with the plurality of elastic unfolding parts when the flipping parts are in the snap connection state;

when the first snapping part is used for snap connection with the flipping parts and the elastic gripping part, the flipping parts engage with the second snapping part to achieve that the second snapping part is in a state of snap connection with the plurality of elastic unfolding parts when the flipping parts are in the snap connection state;

when the first snapping part is used for snap connection with the elastic gripping part, the elastic gripping part engages with the flipping parts to achieve that the flipping parts are in the snap connection state when the elastic gripping part is in the snap connection state, the flipping parts engage with the second snapping part to achieve that the second snapping part is in a state of snap connection with the plurality of elastic unfolding parts when the flipping parts are in the snap connection state.

3. The flipping and transforming toy vehicle capable of gripping toys according to claim 2, characterized in that the elastic gripping part is an elastic single-arm gripping part, said elastic single-arm gripping part is disposed on the upper inner side surface or lower inner side surface of the opening, said elastic single-arm gripping part engages with the first snapping part or the flipping part to achieve that the elastic single-arm gripping part grips the toy when the toy touches the first snapping part to release the snap connection from the flipping parts and/or the elastic single-arm gripping part, or the elastic single-arm gripping part uses its own elasticity to achieve that, when the toy enters the opening, the elastic single-arm gripping part is first squeezed and then the elasticity of the elastic single-arm gripping part is restored to grip the toy.

4. The flipping and transforming toy vehicle capable of gripping toys according to claim 3, characterized in that the elastic single-arm gripping part is an elastic tilting plate, the center of the elastic tilting plate is installed, through a rotating shaft and a torsional spring, at a position on the lower inner side surface of the opening, the rear part of the elastic tilting plate restricts, through the snap connection with the flipping parts, the front part of the elastic tilting plate from tilting upwardly, the flipping parts are in snap connection through the first snapping part, the toy touches the first snapping part when entering the opening, such that the first snapping part releases the snap connection from the flipping parts to flip the flipping parts and further release the snapping of the elastic tilting plate, thereby making the front part of the elastic tilting plate to tilt upwardly and lock the toy.

5. The flipping and transforming toy vehicle capable of gripping toys according to claim 3, characterized in that the elastic single-arm gripping part is an elastic locking protrusion, the elastic locking protrusion comprises a locking seat, a spring and a boss, the locking seat is designed integrally with the upper inner side surface of the opening, the spring is installed inside the locking seat, the boss is inserted into the locking seat and partially extends out of the locking seat, when the toy enters the opening, the toy first squeezes the boss, and under the elastic force of the spring, the boss extends downwardly to grip the toy.

6. The flipping and transforming toy vehicle capable of gripping toys according to claim 3, characterized in that the first snapping part is a snapping plate disposed inside the toy vehicle and capable of moving forwardly and backwardly, the front end of the snapping plate extends out of the toy vehicle and into the opening, but does not extend out of the opening, the rear end of the snapping plate is connected to a reset spring that enables the snapping plate to automatically move forwardly and reset after moving backwardly, the bottom surface of the front part of the snapping plate is provided downwardly with a hook, the flipping part is correspondingly provided with a hole for engagement with the hook, thereby achieving the snap connection of the flipping part through the snapping plate.

7. The flipping and transforming toy vehicle capable of gripping toys according to claim 2, characterized in that the elastic gripping part is an elastic double-arm gripping part, said elastic double-arm gripping part is disposed on two sides of the opening, respectively, said elastic double-arm gripping part engages with the first snapping part or the flipping part to achieve that the elastic double-arm gripping part grips the toy when the toy touches the first snapping part to release the snap connection from the flipping parts and/or the elastic double-arm gripping part.

8. The flipping and transforming toy vehicle capable of gripping toys according to claim 7, characterized in that the elastic double-arm gripping part comprises two gripping arms that are installed, through a rotating shaft and a torsional spring, on two sides of the opening and rotate backwardly to be drawn together to two sides of the toy vehicle, the two gripping arms maintain the to-be-gripped state through the snap connection with the first snapping part when they are drawn together to two sides of the toy vehicle, and at this moment, the elastic force of the torsional spring is in a restricted state.

9. The flipping and transforming toy vehicle capable of gripping toys according to claim 8, characterized in that the first snapping part is a snapping plate disposed inside the toy vehicle and capable of moving forwardly and backwardly, the front end of the snapping plate extends forwardly inside the toy vehicle and through the opening to go out of the opening, the front end part of the snapping plate is provided with a touch site for the toy to touch and assist the elastic double-arm gripping part to grip the toy, the rear end of the snapping plate is connected to a reset spring that enables the snapping plate to automatically move forwardly and reset after moving backwardly, the bottom surface of the front part of the snapping plate is provided downwardly with a hook, the flipping part is correspondingly provided with a hole for engagement with the hook, thereby achieving the snap connection of the flipping part through the snapping plate.

10. The flipping and transforming toy vehicle capable of gripping toys according to claim 2, characterized in that the fixed part of the toy vehicle is a chassis part, the plurality of elastic unfolding parts together form a vehicle body of the toy vehicle when they are all in the folded state, the snapping assembly is moveably installed on the fixed part, the first snapping part is installed inside the fixed part and capable of moving forwardly and backwardly, the top part of the second snapping part extends out of the fixed part to be in a snap connection with the plurality of elastic unfolding parts and maintain the folded state.

11. The flipping and transforming toy vehicle capable of gripping toys according to claim 2, characterized in that the elastic unfolding part comprises a rotating part that unfolds through rotation when the snap connection state is released, and an engagement part for mutual engagement between the rotating parts when the rotating parts are folded, the rotating parts are connected with the fixed part through the rotating shaft and the torsional spring, and the rotating parts maintain the vehicle form, after being drawn together and engaged, by resisting the elastic force of the torsional spring through the second snapping part.

12. The flipping and transforming toy vehicle capable of gripping toys according to claim 11, characterized in that the second snapping part is a snap connection piece capable of moving forwardly and backwardly, the top part of the snap connection piece is provided forwardly or backwardly with a protrusion for snap connection with the buckle correspondingly provided on the rotating part, a reset spring capable of automatically resetting the snap connection piece after moving is provided between the snap connection piece and the fixed part, the bottom part of the snap connection piece engages with the flipping parts or the first snapping part to achieve that the snap connection piece is driven to move forwardly or backwardly when the flipping part flips or the first snapping part acts, thereby releasing the snap connection from the rotating part such that the rotating part is unfolded to transform the toy vehicle from the vehicle form to the second form.

13. The flipping and transforming toy vehicle capable of gripping toys according to claim 12, characterized in that the snap connection piece comprises a snap connection plate formed with a wedge-shaped hole in the center thereof, a wedge-shaped block inserted into the wedge-shaped hole, and a tension spring connected to the rear part of the snap connection plate, the snap connection plate is installed on the top surface of the fixed part and capable of moving forwardly and backwardly, the front end of the snap connection plate is provided with the protrusion for snap connection with the buckle of the rotating part, the reset spring is provided between the top part of the wedge-shaped block and the fixed part, the bottom part of the wedge-shaped block extends out of the vehicle bottom to the position of the flipping parts, the flipping parts restrict the wedge-shaped block from moving downwardly when the flipping parts are in the snap connection state, such that the snap connection plate is in the forward-moving state and the snap connection between the protrusion and the buckle is realized, when the flipping part flips, the restriction on the wedge-shaped block is released, such that the wedge-shaped block moves downwardly under the elastic force of the reset spring, thereby making the snap connection plate to move backwardly under the action of the tension spring to consequently release the snap connection between the protrusion and the buckle.

14. The flipping and transforming toy vehicle capable of gripping toys according to claim 12, characterized in that the snap connection piece is a snap block capable of moving forwardly and backwardly, the rear end of the snap block is provided with the protrusion for snap connection with the buckle of the rotating part, the reset spring is provided between the front end of the snap block and the fixed part, the bottom end of the snap block is provided with a boss by extending downwardly, the boss goes downwardly through the vehicle bottom to the position of the flipping parts, the rear end of the flipping part is correspondingly provided with a drive block that slants backwardly and downwardly, when the flipping part flips, the drive block rotates relatively forwardly and upwardly to drive the boss to move forwardly, thereby making the snap block to synchronously move forwardly and releasing the snap connection between the protrusion and the buckle.

15. The flipping and transforming toy vehicle capable of gripping toys according to claim 1, characterized in that the snapping assembly is a general snapping plate, the snap connection of all of the flipping parts, the elastic gripping part, and the elastic unfolding parts is achieved through the general snapping plate, the front end of the general snapping plate extends out of the toy vehicle and into the opening, when the toy vehicle is pushed toward the toy such that the toy enters the opening and touches the general snapping plate, the general snapping plate releases the snap connection from the flipping parts, the elastic gripping part and the elastic unfolding parts, thereby achieving that the toy vehicle grips the toy and flips to transform to a second form.

16. The flipping and transforming toy vehicle capable of gripping toys according to claim 1, characterized in that the flipping part is a flipping plate with the rear end passing through the rotating shaft and the torsional spring and installed at the bottom of the toy vehicle, when the snapping assembly releases the snap connection from the flipping plate, the front end of the flipping plate flips downwardly and backwardly around the rotating shaft by 150° to 180°.

17. The flipping and transforming toy vehicle capable of gripping toys according to claim 1, characterized in that the second form of the toy vehicle after the transformation from the vehicle form is an animal form.

18. The flipping and transforming toy vehicle capable of gripping toys according to claim 1, characterized in that the toy is a disc, a boss is provided at the center of both surfaces of the disc, a groove is formed between the boss and the periphery of the disc, the periphery of the disc extends outwardly with a projecting ring, and the surface of the boss is attached or embossed with a pattern for differentiating each toy.

* * * * *